United States Patent [19]

Amabili

[11] 3,977,576

[45] Aug. 31, 1976

[54] SPRAY CAN AND VALVE CONSTRUCTION

[76] Inventor: Arnaldo Amabili, 2101 Champlain Apt. 416, Montreal, Quebec, Canada

[22] Filed: Feb. 24, 1975

[21] Appl. No.: 552,421

[52] U.S. Cl. ..... 222/402.1; 222/542; 29/453; 29/510; 29/516

[51] Int. Cl.[2] ..... B65D 83/14

[58] Field of Search ..... 222/402.1, 542, 402.24; 29/453, 510, 516

[56] References Cited

UNITED STATES PATENTS

| | | | |
|---|---|---|---|
| 2,900,114 | 8/1959 | Utz | 222/402.24 |
| 3,074,601 | 1/1963 | Kuffer | 222/402.24 |
| 3,270,924 | 9/1966 | Kitabayashi | 222/402.1 |
| 3,372,844 | 3/1968 | Kitabayashi | 222/402.1 |
| 3,806,005 | 4/1974 | Prussin et al. | 222/402.16 |
| 3,845,888 | 11/1974 | Focht | 222/402.24 |
| 3,854,636 | 12/1974 | Conway et al. | 222/402.24 |

*Primary Examiner*—Robert B. Reeves
*Assistant Examiner*—Frederick R. Handren

[57] ABSTRACT

An improved aerosol container and valve construction. The container employs a mounting member in an opening in one end of the container body to mount the valve mechanism. The mounting member is tightly seated on a rim surrounding the opening, and maintained in this position by holding means on the body which are spaced from the rim. The valve mechanism is locked in a sealing position in the mounting member by means of a shoulder extending about the valve mechanism and sitting in a groove extending about the mounting member.

3 Claims, 10 Drawing Figures

Fig. 8
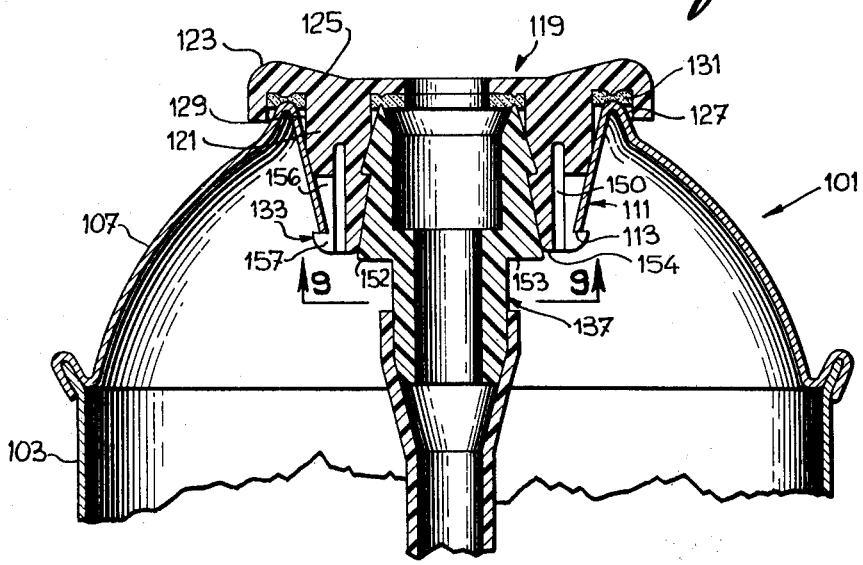
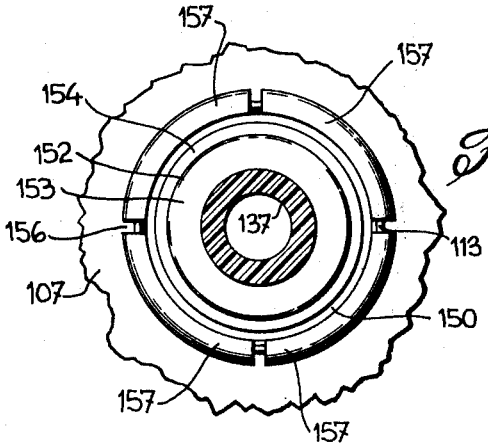
Fig. 9
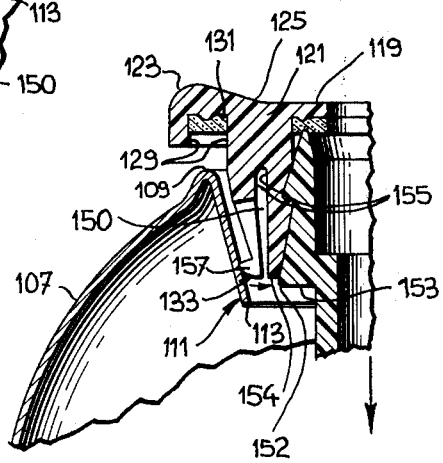
Fig. 10

SPRAY CAN AND VALVE CONSTRUCTION

BACKGROUND OF THE INVENTION

This invention is directed toward improvements in aerosol containers.

The invention is more particularly directed toward improvements in mounting a valve mechanism in one end of aerosol containers.

Aerosol containers now known usually have a valve cup, made of thin material, mounted in one end of the cylindrical body of the container. The valve cup is provided with a central opening and an aerosol valve mechanism projects through the opening in the cup into the cylindrical body. Examples of valve cups are shown in U.S. Pat. Nos. 3,498,506 and 3,664,557.

The use of the valve cup can present problems in sealing it to the container and in rigidly mounting the valve mechanism. The seals may leak and the valve mechanism may become loose. To minimize the leakage problem great care must be exercised in crimping the valve cup to the container end. To try to more rigidly mount the valve, the depth of the cup, where it mounts the valve, may be increased, but this can entail an expensive forming operation.

SUMMARY OF THE INVENTION

It is therefore the purpose of the present invention to provide an aerosol container which dispenses with the normal thin valve cup and uses instead a more rigid yet cheaper and lighter member for mounting the valve mechanism. The use of the rigid mounting member permits simple yet effective sealing of the container by seating and locking the member on a rim thereby eliminating the need for a crimp seal.

The invention is particularly directed toward an aerosol container having a main body with an opening at one end of the main body and a rim about the opening. A mounting member is inserted in the opening in the body and seats on the rim. The mounting member carries a valve mechanism. Means are provided on the body, spaced from the rim, to hold the member in sealing relation on the rim.

In a preferred embodiment, the body has a neck which projects from the one end with the rim on the free end of the neck. The holding means comprises an inward projection on the neck spaced from the rim.

In another embodiment, the body has a neck which projects inwardly into the body from the one end. In this embodiment, the rim is located where the neck joins the one end and the holding means comprises the free end of the neck.

BRIEF DESCRIPTION OF THE DRAWINGS

The invention will now be described in detail having reference to the accompanying drawings in which:

FIG. 8 is a cross-sectional view of the top of an assembled aerosol container according to a further embodiment of the present invention;

FIG. 9 is a bottom view of the top of the assembled aerosol container shown in FIG. 8; and FIG. 10 is a detail cross-sectional view showing how that latter container is assembled.

DESCRIPTION OF THE PREFERRED EMBODIMENTS

Figure 1:
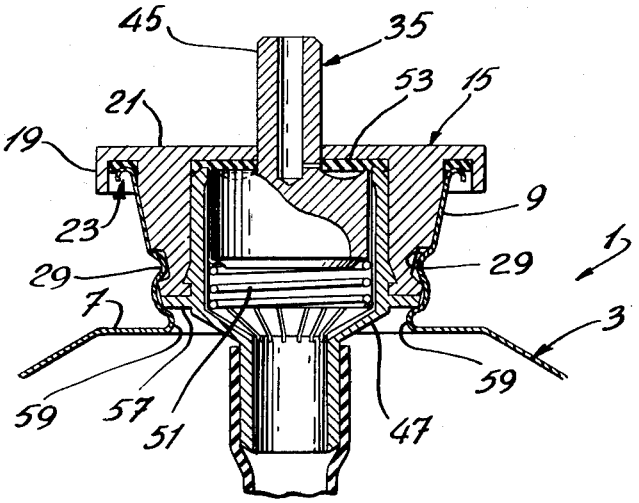
FIG. 1 is a partial cross-sectional view of the top of an assembled aerosol container according to the present invention.
Figure 3:
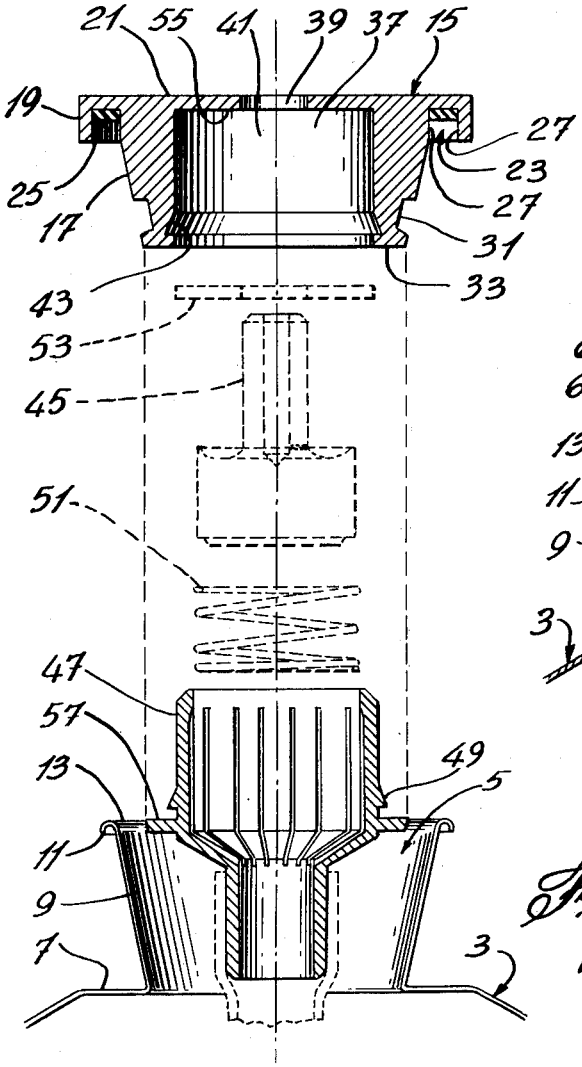
FIG. 3 is a partial cross-sectional view of that same container showing parts in exploded relation.

The aerosol container 1 of the present invention, in the preferred embodiment as shown in FIG. 1, has a main body 3 with an opening 5 in one end 7 of the body. The main body 3 is generally cylindrical in shape and opening 5 is generally circular. The one end 7 is the top end of the container. As shown in FIG. 1, the opening 5 is actually in a frusto-conical neck 9 which projects outwardly from the center of the one end 7 of the body 3. The top edge 11 of the neck 9 is rolled over outwardly to define a circular rim 13 surrounding the opening 5. The neck 9 tapers inwardly from rim 13 toward end 7.

A mounting member 15 is provided for insertion into the opening 5 to close it. The mounting member 15 preferably is molded from suitable thermoplastic material, and has a main frusto-conical body portion 17 with a projecting flange 19 at its large end 21. The flange 19 is sized to sit on the rim 13 when the member 15 is inserted into neck 9. Preferably the flange 19 has a circular undercut groove 23 for receiving rim 13. A resilient ring member 25 is mounted in the groove 23 for sealing against the rim 13. The sides 27 of the groove are preferably parallel to more readily retain the ring 25 in the groove while assembling the container.

To hold member 15 in sealing relation against rim 13, an inwardly projecting surface, preferably in the form of a circular bead 29, is provided in the neck portion 9 spaced from rim 13. The bead 29 sits in a circular groove 31 which extends about member 15 adjacent small end 33, and serves to hold member 15 in sealing relation against rim 13.

The mounting member 15 retains the valve mechanism 35 for the aerosol container. To this end, member 15 is provided with a circular bore 37 extending inwardly from end 33 toward end 21. A smaller through bore 39 is provided concentric with bore 37. The wall 41 of bore 37 is undercut near end 33 to provide a circular groove 43 for use on mounting the valve mechanism 35.

The valve mechanism 35 includes a stem portion 45 which, when the valve mechanism 35 is mounted in member 15, projects through bore 39. Stem 45 is mounted within a main body 47 which main body 47 slides snugly into bore 37. Main body 47 has a projecting circular shoulder 49 which sits in groove 43 to lock body 47 in member 15. Stem 45 is biased outwardly by a spring 51 against a seal 53 seated against the end wall 55 of bore 37.

Main body 47 preferably has a circular flange 57 which, when body 47 is positioned and locked in bore 37, sits against end 33 of member 15. To insure that body 47 is retained in bore 37 while the valve mechanism 35 is operated, at least a portion of the neck 9 is crimped in adjacent flange 57 to form a projection 59 serving to clamp the flange against member 15. Sealing material may be provided on the edges 61 of flange 57, and edge 63 of member 15 between projection 59 and bead 29 to provide an air-tight seal for the valve mounting. The remainder of the valve mechanism is well known and no further description of it is necessary for an understanding of the invention.

Figure 2:
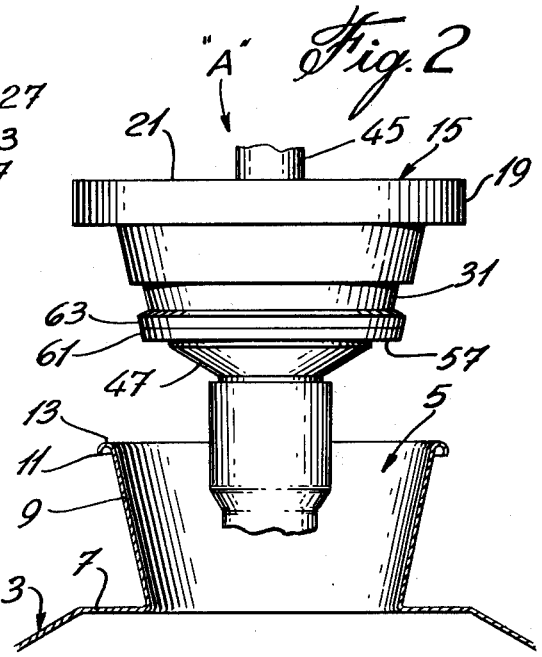
FIG. 2 is a partial cross-sectional view of that container during an assembly step.
Figure 5:
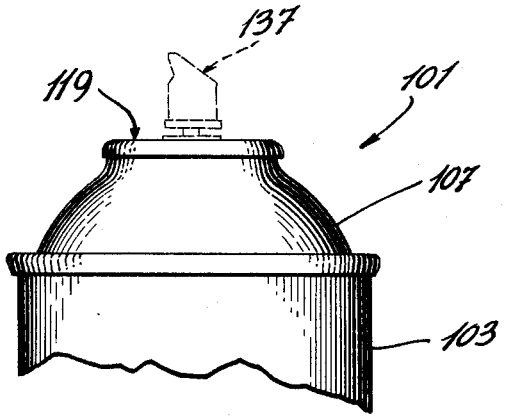
FIG. 5 is a partial front elevation view of the container shown in FIG. 4.
Figure 4:
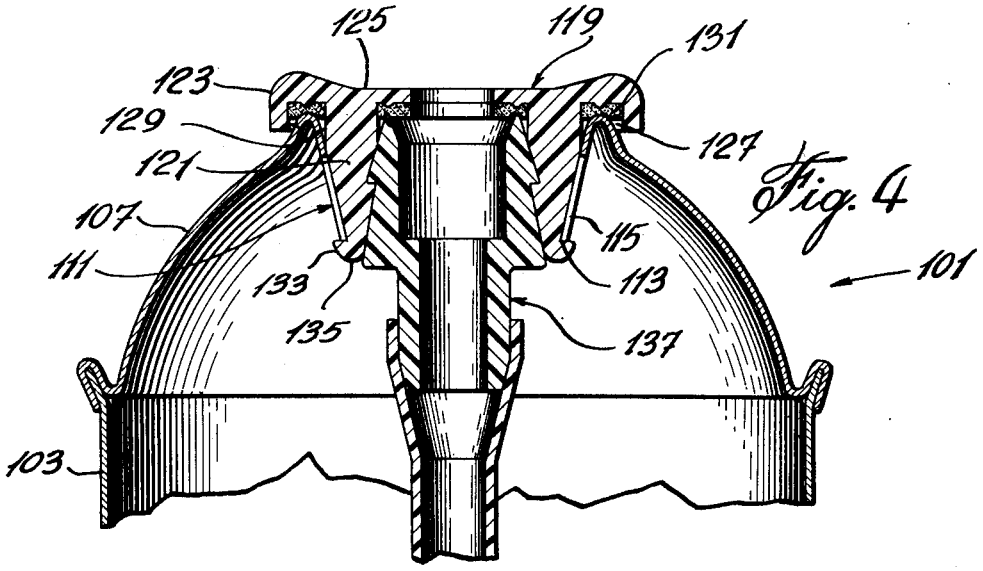
FIG. 4 is a cross-sectional view of the top of an assembled aerosol container according to another embodiment of the present invention.
Figure 6:
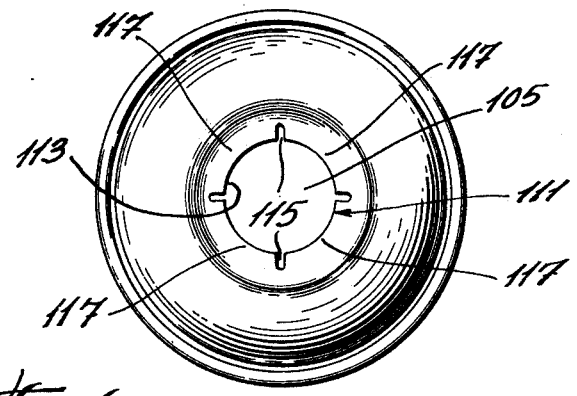
FIG. 6 is a top elevation view of the top of the container body shown in FIG. 4 and FIG. 5.

In the manufacture of the above described container, the main body 3 is provided having a straight-wall projecting frusto-conical neck 9 as shown in FIG. 2. The rim 13 has already been formed on the neck 9.

The valve mechanism 35 is then assembled and locked to member 15. The assembled unit "A" is then inserted into opening 5 in neck 9, as shown in FIG. 2 until the wall of member 15 mates with the neck 9 at which time rim 13 is pushed into resilient seals 25. The elements are maintained in this position by suitable means while circular beads 29 and 59 are formed in neck 9 to lock the unit A in place with flange 57 held against end 33. The sealing material previously mentioned, may be applied about edges 61, 63 before unit A is inserted into the neck.

As will be seen, bead 29 serves to retain the mounting member 15 in sealing relation on the rim 13 while the neck 9 holds mounting member 15 to provide a firm stable mount for the valve mechanism 35.

In another embodiment of the invention as shown in FIGS. 4 to 7 the container 101 comprises a main, generally cylindrical body 103 having an opening 105 centrally located in one end 107. The end 107 in this embodiment is shown to be rounded but it can be flat as well. The opening 105 is surrounded by a rim 109 and a neck 111 projects inwardly of the end 107, from rim 109. The neck 111 tapers inwardly and terminates in a free circular edge 113. Four equally spaced apart slots 115 extend up from edge 113 toward rim 109 in the neck 111, dividing the neck into cantilevered sections 117.

A mounting member 119, similar to that previously described, is mounted in the neck 111 to close opening 105. The member 119 has a main body 121 which is frusto-conical in shape. A circular flange 123 is provided at the large end 125 of the body 121 for seating on rim 109. A circular groove 127 is preferably formed in the flange 123 for receiving rim 109. The groove 127 has parallel sidewalls 129 and an annular resilient member 131 is mounted in the groove to bear on rim 109 to seal the opening 105 when the mounting member 119 is inserted into neck 11.

The member 119 also has a circular flange 133 at its small end 135. The free edge of neck 111 rests on flange 133 to lock the member 117 in the neck in sealing relation.

Figure 7:
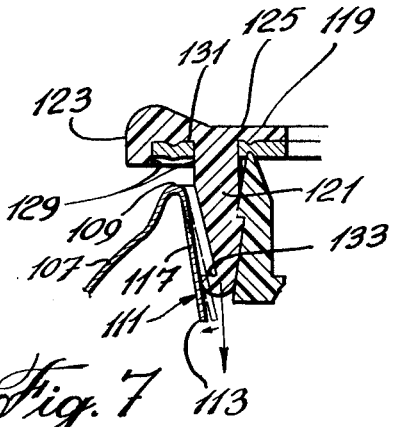
FIG. 7 is a detail cross-sectional view showing how that container is assembled.

The slots 115, serving to divide the neck 111 into cantilevered sections 117, permit the member 119 to be mounted in the neck. As shown in FIG. 7 the sections 117 flex outwardly allowing bottom flange 133 of member 119 to pass past edge 113 to lock the member in place.

The mounting member 119 supports a valve mechanism 137 as before.

In a further embodiment of the invention as shown in FIGS. 8 to 10, which is a variant of the above described embodiment referring to FIGS. 4 to 7, the neck 111 tapering inwardly terminates in a free circular slot-less edge 113.

The main body 121 of the mounting member 119 is provided with a circular thin groove 150 which extends inwardly up from its lower end 154. That groove 150 has parallel sidewalls 155. Four equally spaced apart slots 156 extending up from the external lower end of the circular flange 133 divide that circular flange 133 and the lower external part of the main body 121, formed by the groove 150, into four sections 157.

The slots 156 permit the member 119 to be mounted in a rigid neck, since, as shown in FIG. 10, the sections 157 flex inwardly allowing the bottom flange 133 of the member 119 to pass part edge 113 to lock the member in place.

I claim:

1. An aerosol container having a main body, an opening in the main body at one end thereof, a neck portion extending and tapering inwardly into the body from the one end of the body, which neck portion is provided with a plurality of spaced apart slots extending upwardly from the free edge thereof to permit the neck portion to elastically open up, a rim located where the neck portion joins the one end, a mounting member insertable into the neck portion and seating on the rim, means comprising the free edge of the neck portion resting on a flange extending about the mounting member to hold said mounting member in sealing relation on the rim, a valve mechanism insertable into the mounting member, and means comprising a shoulder extending about the valve mechanism and sitting in a groove extending about the mounting member to lock the valve mechanism in a sealing position in the mounting member.

2. A container as claimed in claim 1, wherein the mounting member is provided with a second flange at one end for resting on the rim, the flange extending about the mounting member for receiving the free edge of the neck portion being located at the other end thereof.

3. An aerosol container having a main body, an opening in the main body at one end thereof, a neck portion projecting out from the one end of the body, a rim located at the free edge of the neck portion, a mounting member insertable into the neck portion and seating on the rim, said mounting member being provided with a flange extending outwardly and having an undercut groove for receiving the rim, and with a resilient member mounted in the undercut groove for bearing on the rim, a valve mechanism insertable into the mounting member, means on the neck portion comprising a surface spaced from the rim, extending about the neck portion and projecting inwardly in a depression extending about the mounting member and a second surface located below the first surface, extending about the neck portion and projecting inwardly under the mounting member, said second surface bearing against a portion of the valve mechanism, to hold the mounting member in sealing relation on the rim, and means comprising a shoulder extending about the valve mechanism and sitting in a groove extending about the mounting member to lock the valve mechanism in a sealing position in the mounting member.

* * * * *